United States Patent [19]

Brown et al.

[11] Patent Number: 4,612,431

[45] **Date of Patent: * Sep. 16, 1986**

[54] PACKAGE ASSEMBLY AND METHOD FOR STORING AND MICROWAVE HEATING OF FOOD

[75] Inventors: Richard K. Brown, Appleton; Oscar E. Seiferth, Madison, both of Wis.

[73] Assignee: James River - Norwalk, Inc., Norwalk, Conn.

[ * ] Notice: The portion of the term of this patent subsequent to Nov. 26, 2002 has been disclaimed.

[21] Appl. No.: 738,490

[22] Filed: Jun. 21, 1985

Related U.S. Application Data

[62] Division of Ser. No. 637,057, Aug. 2, 1984, Pat. No. 4,555,605.

[51] Int. Cl.[4] ..... H05B 6/64

[52] U.S. Cl. ..... 219/10.55 E; 219/10.55 F; 426/107; 426/243; 99/DIG. 14

[58] Field of Search ..... 219/10.55 E, 10.55 F, 219/10.55 M, 10.55 R; 126/390; 426/107, 110, 113, 241, 234, 243; 99/451, DIG. 14, 644, 645; 206/45.12, 45.2, 45.21, 45.31, 634, 830

[56] References Cited

U.S. PATENT DOCUMENTS

| | | | |
|---|---|---|---|
| 2,960,218 | 11/1960 | Cheeley . | |
| 2,993,633 | 7/1961 | Keller | 206/45.21 |
| 3,031,309 | 4/1962 | Bogner et al. . | |
| 3,071,307 | 1/1963 | Keller | 206/45.21 |
| 3,511,288 | 5/1970 | Swett et al. | 206/45.2 |
| 3,539,751 | 10/1970 | Levinson | 219/10.55 E |
| 3,619,215 | 11/1971 | Bard et al. . | |
| 3,941,967 | 3/1976 | Sumi et al. | 219/10.55 E |
| 3,965,323 | 6/1976 | Forker, Jr. et al. | 219/10.55 E |
| 4,190,757 | 2/1980 | Turpin et al. | 219/10.55 E |
| 4,230,924 | 10/1980 | Bradstad et al. | 219/10.55 E |
| 4,267,420 | 5/1981 | Brastad | 219/10.55 E |

*Primary Examiner*—Philip H. Leung

*Attorney, Agent, or Firm*—Sixbey, Friedman & Leedom

[57] ABSTRACT

A packaged arrangement (1) contains a tray (4) which is convertible into a heating stand by inversion thereof. The walls of the tray are of a material that is transparent to microwave energy, but a support wall (10) which forms a bottom of the tray and top of the stand is provided with a liner of a microwave interactive layer that is formed of a material capable of converting microwave energy into heat. The tray (4) is configured so as to define a storage space for a predetermined quantity of food and to possess sufficient strength as to be able to support the predetermined quantity of food upon the support wall (10) in the inverted, heating stand condition thereof. A second packaged arrangement (1') comprises a recloseable package body (2') that may be used, at least in part, to form the enclosed air space and stand. In accordance with methods of use, food is removed from the package, at least one of the components of the packaged arrangement is formed into an air space enclosing heating stand, upon the floor of a microwave oven, and the food is placed upon this stand during microwave heating thereof.

12 Claims, 7 Drawing Figures

PACKAGE ASSEMBLY AND METHOD FOR STORING AND MICROWAVE HEATING OF FOOD

DESCRIPTION

This is a division of application Ser. No. 637,057, filed Aug. 2, 1984, now U.S. Pat. No. 4,555,605, issued Nov. 26, 1985.

1. Technical Field

This invention relates generally to microwave food packages and more particularly to food packages of the type which include an element that will produce a heating effect when exposed to microwave energy for the purpose of crisping or browning food contained thereon.

2. Background Art

In recent years the percentage of homes containing microwaves ovens has grown dramatically. This has resulted in an associated growth in the demand for microwaveable prepared foods, such as frozen pizzas and the like. However, when the manufacturers of prepared foods attempted to meet this marketplace demand, they found that a difficulty existed in overcoming the common complaint of consumers to the effect that food cooked by microwave energy lacked the desired degree of browning or crispness that such foods normally have when cooked in a conventional oven. This problem is particularly acute with respect to foods that are required to be selectively exposed to microwave radiation to a greater or lesser extent in certain portions thereof. Furthermore, while auxiliary implements are known to facilitate heating and cooking of such difficult to microwave foods (see, for example, U.S. Pat. Nos. 3,539,751; 3,941,967 and 3,965,323), it is undesirable, from a commercial standpoint, for manufacturers of frozen prepared foods and the like to have the success of a product depend on the availability, in the home, of such auxiliary cooking devices. Additionally, requiring the use of such auxiliary devices detracts from one of the reasons why consumers buy ready-prepared foods in that such auxiliary devices, not being disposable, create the inconvenience of an item that must be washed for later use.

In view of the foregoing, various specialized packages have been developed which are designed to achieve microwave browning of food contained therein. Specifically, such packaging involves the preparation of a package body into which is incorporated a film or element that will convert microwave energy into thermal energy so as to produce a browning and/or crispening of an item of food situated in heat exchange contact therewith. Furthermore, such packages have been designed so as to produce a selective heating of various portions of the food to a greater or lesser extent than other portions.

A first type of such packaging is represented by Brastad, U.S. Pat. No. 4,267,420 and Brastad et al, U.S. Pat. No. 4,230,924 wherein flexible sheets of microwave interactive materials are wrapped closely about individual items of food so that when the package is exposed to microwave energy, the interactive material will convert at least a portion of the impinging microwave energy into heat for browning the food surface. However, such packages pose problems with various types of food, in that, during heating, grease or vapor driven out of the food may create leakage and/or venting problems, and such packaging is totally unsuitable for foods, such as pizza, which have components which will adhere to a contacting wrapping paper and thus be rendered unappetizing when the packaging material is removed.

A second approach is represented by Turpin et al U.S. Pat. No. 4,190,757, which discloses a microwaveable package which does not require the product to be closely wrapped. In accordance with this patent, a microwave interactive layer is supported on or adjacent one of the inside container walls for browning food which is positioned therein. However, when the microwave interactive layer is directly on the inside container wall, the amount of heat transferred between the interactive layer and the food being browned, may vary over the surface area of the foods due to surface or dimensional irregularities of the food and non-uniform size variation of the food.

On the other hand, while the supporting of the microwave interactive layer above the inside container wall creates an air space which has the effect of more evenly distributing the heat to the underside of the product, the provision of a supporting stand for the interactive layer and food has a significant effect upon the cost of packaging a given food item, since the size of the package is significantly increased beyond that which otherwise would be required to package the food item. This, in turn, increases the size of the box that will be required to ship a number of packages to the retailer, not to mention the increased cost associated with producing a complex package, as opposed to a simple box-type structure.

Moreover, a disadvantage exists with the packages constructed in accordance with the teachings of the Turpin et al patent since they are provided with holes or openings which are used to regulate the amount internal heating and to vent vapor and moisture. That is, since the food is heated in the same package in which it is displayed, some vaporization of the inks used in the package graphics may occur causing ink vapors to become absorbed into the foods themselves. Such an effect can adversely affect the taste of the food, and a consumer would be less likely to purchase or use a dirty package.

Presently known approaches to the packaging of foods for microwave cooking all focus on the "cook-in" disposable package of the above-noted types that are subject to the aforementioned problems. However, no package assembly or packaged arrangement has been disclosed wherein simple, package design concepts as applied to non-microwaveable foods can be utilized while obtaining the benefits, without the detriments, of the the more sophisticated microwave package designs incorporating microwave interactive layers.

DISCLOSURE OF THE INVENTION

It is an object of the present invention to provide a novel and improved package assembly and packaged food arrangement for use in association with the heating or cooking of the food item in a microwave oven that enables the use of a simple package body of the type utilized in packaging food products that are to be cooked or heated by non-microwave means.

It is a general object of the invention to provide a dual food packaging assembly for use in a microwave oven having a support surface, comprising outer packaging body means initially operable in a packaging mode in which food may be retained within an enclosed food storage space for shipment and storage and subsequently operable in a cooking mode after the food originally located within the enclosed food storage space is removed and the outer packaging means is mechanically manipulated to form a heating stand means for supporting the removed food at a predetermined distance above the microwave oven support surface in heat transfer relation with said microwave interactive layer and for enclosing an air filled space beneath said microwave interactive layer for promoting even cooking of the removed food.

It is another object of the present invention to provide a novel and improved package assembly and packaged food arrangement for use in the storing and microwave heating of a food item wherein the package includes a disposable, combination food storage tray and heating stand which, in a first condition, serves for receiving the food item and holding it within the package body, and in a second, inverted, condition functions as an auxiliary heating member independent of the package body.

It is a specific object of the present invention to provide a disposable paperboard tray which has a flat support wall bounded perimetrically by upwardly projecting walls so as to define a food receiving space, a thin microwave interactive layer being attached on a side of the support wall which faces away from the food receiving space so that, upon opening of the package, the tray may be removed from the package, the food moved from the food receiving space, and the tray inverted and placed within a microwave oven so as to serve as a heating stand upon which the food item is placed for heating and/or cooking.

It is a further object of the present invention to provide a package assembly for microwave cooking use comprised of an outer package and an inner tray, at least one of which is provided with a microwave interactive layer and is usable, after removal of the food from the outer package, to create a stand enclosing an air space within a microwave oven upon which the food may be cooked.

In connection with the preceding object, specific objects include enabling only the outer package, only the inner tray, or a combination of the outer package and tray, to create the air space enclosing stand having a microwave interactive layer upon which food may be cooked in a microwave oven.

It is also an object of the present invention to provide a method of cooking or heating packaged food whereby the food is removed from the package, at least one of the components of the package is formed into an air space enclosing heating stand, with a microwave interactive heating layer, upon the floor of a microwave oven, and the food is placed on this stand during microwave heating thereof.

The above and other objects and advantages of the invention are achieved by a package assembly, in accordance with a preferred embodiment of the invention, which includes a package body in the form of a simple paperboard carton within which a disposable combination food storage tray and heating stand is fully received. The combination tray and stand forms a food storage space that is bounded by a support wall on which a food item or predetermined quantity of food is located and upstanding perimetric walls which laterally enclose the food positioned on the supporting wall. These walls are formed of a material, such as paperboard, which is transparent to microwave energy, and a microwave interactive layer formed of a material capable of converting microwave energy into heat is disposed in association with the support wall, such as by being laminated to an underside thereof. The combination tray and heating stand, so formed, is designed such that the perimetric walls coact with the support wall for converting the food storage space into an enclosed air space when the combination storage tray and heating stand is placed on the floor of a microwave oven in an inverted heating stand condition and is of sufficient strength to support the predetermined quantity of food or food item upon the support wall when the combination storage tray and heating stand is in the inverted heating stand condition with the interactive layer closely associated positionally in heat transfer relationship with respect to the food thereon.

In accordance with modified embodiments, the package body is designed to be recloseable and to be usable alone or in combination with an inner food receiving tray to create an air space enclosing heating stand, with a microwave interactive heating layer, upon the floor of a microwave oven.

In accordance with methods of use of the various embodiments, the food is removed from the outer package, and the outer package and/or the inner food tray is rearranged into an air space enclosing heating stand on the floor of a microwave oven. The food is then placed upon the heating stand, over the enclosed air space, so as to be in heat exchange relationship with a microwave interactive heating layer of the heating stand. Thereafter, the microwave oven is turned on so as to heat the food.

BEST MODE FOR CARRYING OUT THE INVENTION

Figure 1:
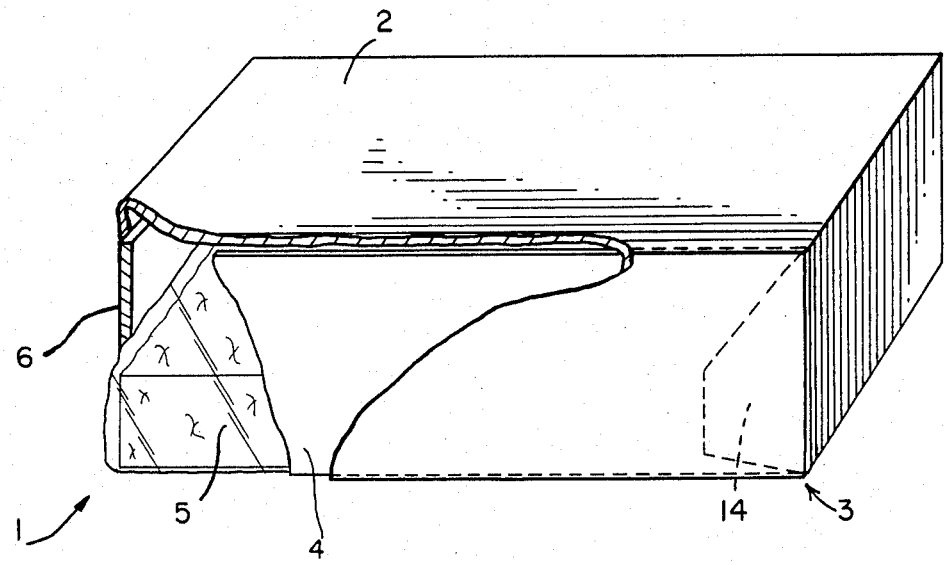
FIG. 1 is a partially cut-away perspective view of a package embodying the present invention including an outer carton, an inner combination food storage tray and heating stand, and a food item received within the combination storage tray and heating stand.

With reference to FIG. 1, the packaged arrangement designated generally by the reference numeral 1 is shown. This packaged arrangement includes a package assembly formed of a package body 2 defining a receiving space 3 and a disposable, combination food storage tray and heating stand 4, as well as a predetermined quantity of food 5, for example, an item of food such as a pizza. Furthermore, the item of food itself may be wrapped within a plastic wrapping, such as a bag 6.

The package body 2 preferably is a paperboard carton and any conventional carton blank may be utilized for the purposes of forming the schematically depicted carton 2. However, while a paperboard carton is preferred, since, in accordance with this embodiment of the present invention, the package body merely serves the function of defining a receiving space for the remainder of the packaged arrangement, the present invention encompasses the use of any form of package body that is known for use in the packaging of "ready-to-heat" foods, such as a plastic bag.

The disposable combination food storage tray and heating stand 3 must possess the following requisites. Firstly, it must be constructed so as to form a food storage space of a size and shape within which the predetermined quantity of food (food item) may be stored and must be sized relative to the receiving space of the package body in order to be fully receivable within the receiving space thereof.

In addition to forming a tray means within which the food may be received, the combination food storage tray and heating stand 3 must be able to function in an inverted condition as a heating stand. To this end, the food storage space is bounded by a support wall 10 and at least one perimetric wall which, together are sized and shaped so as to convert the food receiving space 11 into an enclosed air space when the combination storage tray and heating stand is placed on the floor of a microwave oven in an inverted heating stand condition. While a circular tray would have only a single perimetric wall extending about the periphery of the support wall 10, in the illustrated arrangement for use with a rectangular carton, four perimetric walls 12 are provided. It should also be appreciated that the at least one perimetric wall and the support wall must be of sufficient strength to support the predetermined quantity of food (food item) upon the support wall when the combination storage tray and heating stand is in the inverted heating stand condition as illustrated in FIG. 3.

Figure 3:
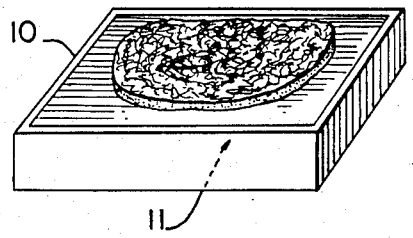
FIG. 3 is a perspective view illustrating the combination food storage tray and heating stand in an inverted heating stand condition and with the food item disposed upon the microwave interactive layer thereof.

Still further, while the support wall 10 and the perimetric walls 12 must be formed of a material that is transparent to microwave energy, in accordance with the present invention, a microwave interactive layer formed of a material capable of converting microwave energy into heat is disposed in association with the support wall 10 so as to be able to heat the predetermined quantity of food when it is supported on the support wall in the inverted heating stand condition of FIG. 3. In this regard, it is noted that, in addition to the direct heating effect of the microwave energy upon the food and transferance of heat from the interactive layer to the food, the enclosed air space 11 will serve to store heat that is produced and act to distribute the heat evenly to the underside of the product in order to facilitate production of a more satisfactorily cooked product.

Figure 2:
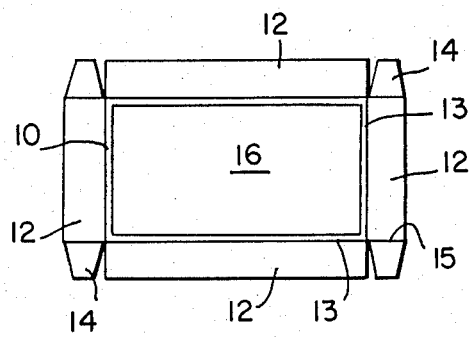
FIG. 2 is a plan view of a blank for forming the combination food storage tray and heating stand illustrated in FIG. 1.

With reference to FIG. 2, a blank for formation of a combination food storage tray and a heating stand is illustrated of a configuration suitable for use with a carton of the type illustrated in FIG. 1. This blank is formed from a paperboard material having sufficient strength and heat and moisture resistance and is totally free of printing. Such paperboard materials are known, per se, and in and of themselves form no part of the present invention apart from their use in the overall combination. As can be seen, the support wall 10 is disposed centrally in the blank and is connected at its edges, defined by score lines 13, to the perimetric walls 12, so that the perimetric walls can be folded into an upstanding position projecting upwardly from the support wall in order to laterally define the food storage space. In order to form a stable tray configuration, tabs 14 are formed by score lines 15 such that a tab is provided on the edge of one of every pair of adjacent edges of walls 12. Thus, the tabs 14 of one wall can be folded at right angles to that wall and secured to the inner side of the other adjacent wall (see right front corner, FIG. 1) such as by an adhesive.

In order to obtain a browning or crisping of the food item, such as a pizza, a microwave interactive layer 16 is bonded or laminated to the support wall 10 on a side, relative to the score lines 13, such that, when the combination tray and heating stand is in an assembled condition, the interactive layer 16 is disposed on a side of the support wall 10 which faces away from the food storage space 11, whereby the predetermined quantity of food (food item) is positionable thereon when the combination storage tray and heating stand is in the noted inverted stand condition of FIG. 3. The material of which the microwave interactive layer is formed in order to be capable of converting microwave energy into heat does not, per se, form part of the present invention and any known interactive material, such as those described in the background art, may be utilized. One suitable type of interactive material is disclosed in Canadian Pat. No. 1,153,069, issued Aug. 30, 1983.

In order to maximize the cost efficient attributes of the present invention, as illustrated in FIG. 1, the packaged arrangement of the present invention utilizes a combination tray and stand whose perimetric walls have their height set so as to correspond to the height of the interior receiving space 3 of the package body and both are coordinated to the height of the predetermined quantity of food (food item) disposed therein. Thus, the minimum amount of packaging materials need be used and the package can be formed as small as practical for the amount of food involved. This is made possible by the fact that there is no need for any heating spaces to be designed into the package arrangement because the food is not cooked within the package body itself, but rather the package assembly is utilized in the following matter.

In particular, a consumer desiring to heat or cook the contents of the package assembly 1 would open up the package body 2 and remove the tray 4 (containing the food item 5) from the receiving space 3 of the package body 2. Then, the consumer would move the food item 5 from the food storage space 11 of the combination tray and stand 4 and then remove any wrapping 6 within which it might be packaged. Next, the tray would be converted into a heating stand by inverting of the combination tray and stand and placing it on the floor of the microwave oven. The interactive layer 16, which had been disposed in the package body, substantially without clearance, upon the bottom wall of the package body 2 would then be in an upwardly directed, exposed condition. The walls of the combination tray and stand, in this converted heating stand condition, will then define the above-noted enclosed air space in conjunction with the floor of the microwave oven. The consumer, thus, need only place the food item upon the support wall, and because of the heat exchange relationship that, thus, would exist between the interactive layer 16 and the food, as well as the heat distributing effect of the enclosed air space, a satisfactorily heated and crisped or browned food item will be produced when the microwave oven is operated in accordance with the proper time and power requirements for the particular food.

Figure 4:
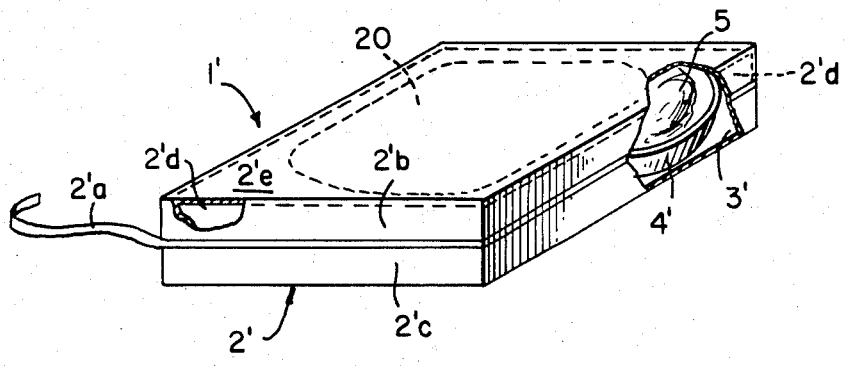
FIG. 4 is a partially cut-away perspective view of another embodiment in accordance with the present invention.

In FIG. 4, a modified packaged arrangement is illustrated, like reference numerals being utilized to identify features common to both of the FIGS. 1 and 4 embodiments, except that a prime designation is utilized to distinguish the modified features of FIG. 4. The packaged arrangement of FIG. 4 also includes a package assembly, this package assembly 1' including an outer package body 2' defining a receiving space 3' and a disposable, inner tray 4' upon which a predetermined quantity of food 5 is situated.

The packaged body 2' is preferably of a construction which will enable the package body to be reclosed, after removal of the food therefrom, for reasons which will become more apparently in connection with the discussion of the methods of use of this embodiment. While any form of recloseable carton may be used as the outer package body, the construction thereof should be one which will not have a high likelihood of being damaged by the consumer during opening of the packaged body, and will have sufficient structural strength, to be able to support the packaged quantity of food 5, with or without the tray 4', thereon.

One known type of package that is suitable for this purpose is illustrated in FIG. 4 and is of the zip-strip opening type. In such a known construction, a pair of serrations or perforations are formed along three or four of the side walls of the package body 2', so as to create strips 2'*a* which may be pulled in a manner ripping a strip from the side walls which will result in the package body 2' being divided into an upper half 2'*b* and a lower half 2'*c*.

Joined to the inner side of the side walls of the lower half 2'*c* are inner side walls 2'*d*, which extend substantially the full height of the package body 2', but which are not affected by the ripping-out of the strip 2'*a* and which are not joined to the upper half 2'*b*. If zip-strips are placed on only three of the side walls, then the package body 2' may be opened in the manner of the valise, the fourth wall serving as a hinge and no inner side wall 2'*d* being required in association therewith.

On the other hand, if zip-strips are provided on all four sides, then four inner walls 2'*d* are utilized. In such a case, after the strips 2'*a* are detached, the top half 2'*b* can be removed and reapplied in a telescoping manner upon the side walls 2'*d*. With either three of four wall zip strips 2'*a*, opening of the package poses a minimal threat of the body of the package being damaged in a manner that would preclude reclosing thereof, and the inner side walls 2'*d* will provide support for the top panel 2'*e* of the package body 2'.

While the inner tray 4 of the FIG. 1 embodiment may be utilized in connection with a packaged body 2', an inner tray 4' in the nature of a paperboard pie pan having sloped walls is shown in FIG. 4, and a flat tray (not shown) may be used as well.

The method of use of the FIG. 4 embodiment will now be described. Like use of the embodiment of FIG. 1, use of the FIG. 4 embodiment involves opening of the packaged body and removal of the inner tray and quantity of food contained therein. However, instead of rearranging the inner tray within a microwave oven so as to form an air space enclosing a heating stand upon which the quantity of food is supportable in heat exchange relationship with the microwave interactive heating layer and enclosed air space, with no use being made of the outer package body for the purpose, the FIG. 4 embodiment not only has the capability of being used in the same manner as the FIG. 1 embodiment, but is capable of various different methods of use, all of which utilize at least part of the outer package body, with or without the heating tray.

Figure 5:
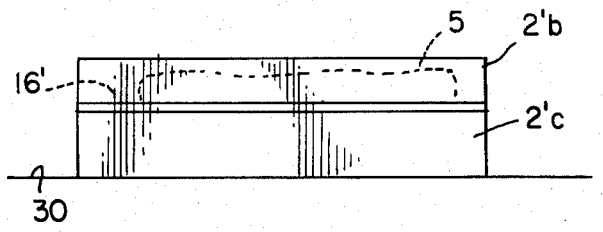
FIGS. 5–7 are diagrammatic views illustrating three different methods of use of the present invention for microwave heating of food.

With regard to the FIG. 5 usage, one half of the outer package body 2', such as the lower half 2'*c*, is placed on the floor 30 of a microwave oven with its open end directed downwardly, and the other half, such as the top half 2'*b*, is placed on top of the first half with its open end directed upwardly. When this manner of use is intended, the broken line enclosed area 20 of wall 2'*e* (FIG. 4) would be a microwave interactive heating layer 16' joined to the underside thereof. The quantity of food 5, thus, would be placed within the package half 2'*b*, in heat exchange relationship with the layer 16' and the enclosed space formed by the package half 2'*c* and oven floor 30. The oven would then be turned on for heating or cooking of the food in the desired manner.

Figure 6:
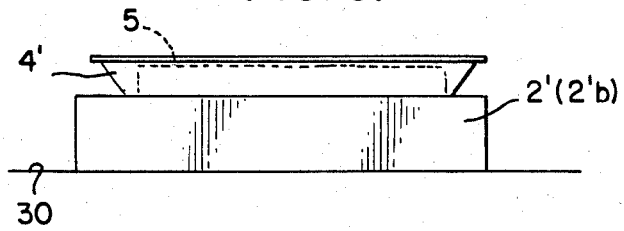

Alternatively, as represented by FIG. 6, either the box 2' is reclosed or one half thereof, such as top half 2'*b*, is placed, open-side down, upon the microwave floor 30, thus forming an enclosed air space. The food 5, in the tray 4', would then be positioned on top of the box 2' or box half 2'*b*. In such a case, a microwave interactive heating layer would be placed on the bottom wall of the tray (and optionally also in the area 20 of the wall 2'*e*). Thus, the food will be supported in heat exchange relationship with both the enclosed air space and the microwave heat interactive layer for heating or cooking purposes.

Figure 7:
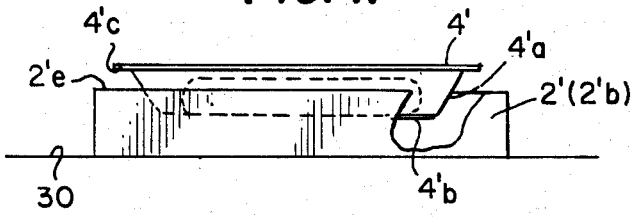

For most efficient usage of the present invention, from a packaging standpoint, the dimensions of the parts of the package assembly will be dictated by the minimums required to enclose a given food item or quantity of food. However, it has been determined that the quality of a food product that is heated in accordance with the present invention, is a function of the height of the air-space confining support wall upon which the food is supported in heat exchange relationship. This height will vary depending upon the size and type of food products involved, but can be determined empirically for any given food product or quantity of food. Thus, to the extent that such can be achieved consistent with the noted packaging concepts, the appropriate components of the package assembly should be dimensioned such that the surface upon which the food will be supported and heated will be situated, approximately, at the empirically predetermined optimized heating height. However, in certain instances, it may not be possible or practical to so dimension the tray, outer package or package half, and in such instances use of the arrangement of FIG. 4 in the manner illustrated in connection with FIG. 7 is advantageous.

That is, by constructing the area 20 of wall 2'*e* as a detachable panel (such as through the use of a ring of perforations or serrations), such as panel can be removed, after opening of the package body 2', so as to create a tray receiving aperture. By dimensioning the size of such an aperture relative to the diameter of the sloping wall 4'*a* of tray 4', the height of the bottom of the tray 4'*b* can be set at any level between a fully inserted position of tray 4' within the aperture within top wall 2'*e* (whereat the pan would be supported by its lip 4'*c* resting on the panel 2'*e*) and the height that would be achieved by simply having the tray 4' rest on the reclosed package or the package half in the manner shown in FIG. 6. As such, regardless of the size of the package, the quantity of food can be supported upon a heating surface that is situated, approximately, at the empirically predetermined optimized heating height.

It is now apparent from the foregoing description of the various embodiments of this invention that the outer carton and the inner tray or the outer carton alone can be considered an outer packaging means which is initially operable in a packaging mode in which food may be retained within an enclosed food storage space for shipment and storage and subsequently operable in a cooking mode after the food originally located within the enclosed food storage space is removed and the outer packaging means is mechanically manipulated to form a heating stand means for supporting the removed food at a predetermined distance above the microwave oven support surface in heat transfer relation with a microwave interactive layer and for enclosing an air filled space beneath the microwave interactive layer for promoting even cooking of the removed food.

It should be recognized that while various embodiments in accordance with the present invention have been described, the present invention is susceptible to numerous changes and modifications which will have become apparent to those skilled in the art from the foregoing disclosure. Therefore, the present invention should not be considered to be limited to the details shown and described herein, but encompasses all such changes and modifications as are within the scope of the claims.

INDUSTRIAL APPLICABILITY

This invention has particular utility in the packaging of food for distribution and sale in refrigerated and frozen display cases now common in most grocery stores. The disclosed package arrangement is ideally suited for packaging, shipping, vending and microwave heating of a variety of food products, but is especially useful in conjunction with those products that are subject to non-uniform heating by microwave energy and/or require browning or crisping on only one side thereof, such as in the case with pizza.

We claim:

1. A food package assembly for use in heating a predetermined quantity of food in a microwave oven having a support surface, comprising:

(a) heating means for converting microwave energy into heat, said heating means including a microwave interactive layer; and (b) packaging means for combining together said heating means and the predetermined quantity of food in a package assembly constructed in a manner enabling it to be disposed in a first configuration for shipping and a second configuration for cooking, said package assembly in said first configuration having the quantity of food disposed within said packaging means without an enclosed air filled space being disposed under the quantity of food, for shipping and storage with a minimum of wasted space, and said package assembly in said second configuration having the quantity of food positionally rearranged relative to said heating means and said packaging means and with said quantity of food being supported in heat transfer relation with respect to said microwave interactive layer above an enclosed air filled space that is formed by at least a portion of said packaging means for promoting even cooking of the food when said portion of the packaging means is situated upon a support surface of a microwave oven.

2. A food package assembly for use in heating a predetermined quantity of food in a microwave oven having a support surface, comprising:

(a) heating means for converting microwave energy to heat, said means including a microwave interactive layer for browning and crisping of food; and (b) packaging means for combining together said heating means and the predetermined quantity of food in a package assembly, said packaging means comprising separate and distinct inner and outer packaging components, said inner packaging component being sized and configured for being received, along with said predetermined quantity of food, within a receiving space defined by the outer packaging component in a first configuration of said packaging assembly for shipping, and said inner packaging element being removable from said receiving space for enabling the packaging assembly to be converted into a second configuration for cooking, said quantity of food being positionally rearranged relative to at least one of said packaging components and situated in heat transfer relationship with respect to said microwave interactive layer above an air-filled space that is formed, at least in part, by said at least one positionally rearranged packaging component for promoting even cooking of the food when said at least one positionally rearranged component is disposed upon a support surface of a microwave oven.

3. A food package assembly according to claim 2, wherein said heating means is affixed to said outer packaging component.

4. A food package assembly according to claim 3, wherein said predetermined quantity of food is rearranged relative to both said heating means and said inner packaging component in said second configuration.

5. A food package assembly according to claim 2, wherein said heating means is affixed to said inner packaging component.

6. A food package assembly according to claim 5, wherein said heating means is affixed to said outer packaging component.

7. A food package assembly according to claim 2, wherein said at least one positionally arranged packaging component comprises a component to which said heating means is affixed.

8. A food package assembly according to claim 2, wherein said inner packaging component comprises a removable tray sized for receipt within said receiving space with the quantity of food thereon when the package assembly is in said first configuration.

9. A food package assembly according to claim 8, wherein said removable tray is formed of microwave transparent material and has a support wall bounded by a perimetric wall, said support being sized for receiving the quantity of food thereon, and wherein said microwave interactive layer is attached to the support wall of the removable tray.

10. A food package assembly according to claim 9, wherein said outer packaging component is a package body that is reclosable after removal of said removable tray and is constructed for supporting said removable tray on its exterior, with the quantity of food thereon, in said second configuration of the package assembly.

11. A food package assembly according to claim 10, wherein said outer package body is provided with an opening forming panel portion sized for providing a tray receiving opening, and said removable tray being constructed for suspending itself within an opening formed by removal of said panel portion in said second configuration of the package assembly.

12. A food package assembly according to claim 9, wherein said perimetric wall is provided with sufficient strength to support the quantity of food, independent of said outer package body, when said removable tray is placed in an inverted condition and the quantity of food is placed thereon in said second configuration of the package assembly.

* * * * *